United States Patent [19]

Hayashi

[11] 4,333,612

[45] Jun. 8, 1982

[54] APPARATUS FOR STORAGE OF ICE

[75] Inventor: Takeshi Hayashi, Naruto, Japan

[73] Assignee: Kyoei Zoki Kabushiki Kaisha, Naruto, Japan

[21] Appl. No.: 98,018

[22] Filed: Nov. 27, 1979

[51] Int. Cl.[3] ..... B02C 18/12

[52] U.S. Cl. ..... 241/33; 241/101.3; 241/236; 241/DIG. 17

[58] Field of Search ..... 62/320, 321; 241/236, 241/DIG. 17, 101.3, 33

[56] References Cited

U.S. PATENT DOCUMENTS

| | | | |
|---|---|---|---|
| 2,202,892 | 6/1940 | Berry et al. | 241/236 |
| 4,008,740 | 2/1977 | Chermack | 241/DIG. 17 |
| 4,179,074 | 12/1979 | Flavel | 241/34 |

FOREIGN PATENT DOCUMENTS

| | | | |
|---|---|---|---|
| 2600454 | 7/1977 | Fed. Rep. of Germany | 241/236 |

*Primary Examiner*—John McQuade

*Attorney, Agent, or Firm*—Blanchard, Flynn, Thiel, Boutell & Tanis

[57] ABSTRACT

Apparatus for the storage of ice which includes a housing for storing pieces of ice. The housing is shaped in the form of a frustum, is interiorly thermally insulated at least on the sidewall and has a top feeding opening and a bottom outlet opening. The scratching-off device is positioned adjacent the bottom opening. The ice is scratched off and dropped continually downwardly toward a delivery station positioned below the scratching-off device and communicating with the bottom opening, where the pieces of ice are removed. The apparatus may also include a measuring device positioned adjacent the delivery station, with which a definite amount of ice delivered from the delivery station is measured out. Thus it is possible to remove pieces of ice stored smoothly, continually and efficiently.

9 Claims, 13 Drawing Figures

APPARATUS FOR STORAGE OF ICE

FIELD OF THE INVENTION

This invention relates to apparatus for the storage of ice capable of keeping broken ice in cold storage at low temperatures for a long period of time and for the removal of a desired amount thereof.

BACKGROUND OF THE INVENTION

Various forms of ice exist, such as (1) chunks or blocks of ice which are large lumps weighing about 50 kg and, accordingly, have a small ratio of superficial area to weight and melt very little, (2) broken ice pieces smaller than the ice chunks, (3) plates of ice having a thickness of about 3 to 10 mm and (4) slices of ice less than 3 mm in thickness. They will all be called generically pieces of ice. The pieces of ice are used in large quantities for the purpose of keeping fresh fish cool. Usually, pieces of ice are stocked in an icebox in substantial amount, from which a suitable amount of ice is taken out for use whenever necessary.

The superficial layer on the pieces of ice are, during storage in heaps, liable to melt and then become united as secondary ice forms constituting large aggregative masses of ice. Consequently, it is not easy to remove ice from a refrigerated storage housing when it is in large pieces. It is particularly extremely difficult to remove pieces of ice in a downward direction from the storage area because such secondary ice forms, when refrozen, stagnate in the form of a bridge between the interior walls of the storage area.

The aggregation of ice thus assuming a bridge state does not drop evenly when any attempt is made to remove it with the aid of a scratching-off device at the lower part of the storage area and a void space is formed above the scratching-off device, so that the device runs idle and the scratching-out operation is discontinued. Accordingly, every such situation demands a breaking up of the aggregative masses of refrozen ice, which requires troublesome labor and results in a decrease in the efficiency of operation.

In view of the drawbacks inherent in the prior art apparatus, the present invention has been developed to provide a novel apparatus for storage of pieces of ice capable of eliminating the drawbacks thoroughly and still be suitable for mechanization. The apparatus is comprised of a housing which is of a frustum of pyramid or cone shaped which is increased in cross-sectional area from top to bottom and is formed with a thermal insulation on the internal sidewall thereof. A scratching-off device for scratching and dropping pieces of ice is provided at a position corresponding to a bottom opening of said housing and is adapted to drop the pieces of ice within the housing downwardly in sequence and continually by the energization and actuation and the scratching-off device in order that the pieces of ice can be subsequently removed from a delivery station positioned below the scratching-off device.

BRIEF DESCRIPTION OF THE DRAWINGS

The invention will be hereinafter described in greater detail with reference to the accompanying drawings, in which.

DETAILED DESCRIPTION

Figure 1:
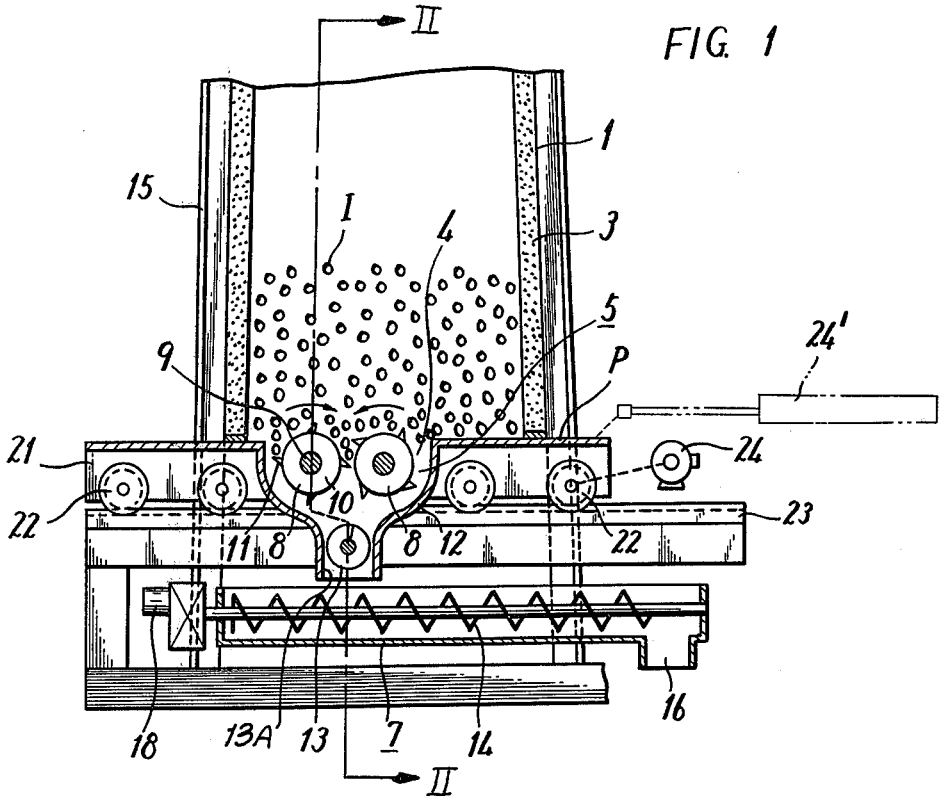
FIG. 1 is a partial elevational view in cross section of a structure showing a fundamental principle of an apparatus of this invention except for the scratching-off device and the upper delivery conveyor.
Figure 2:
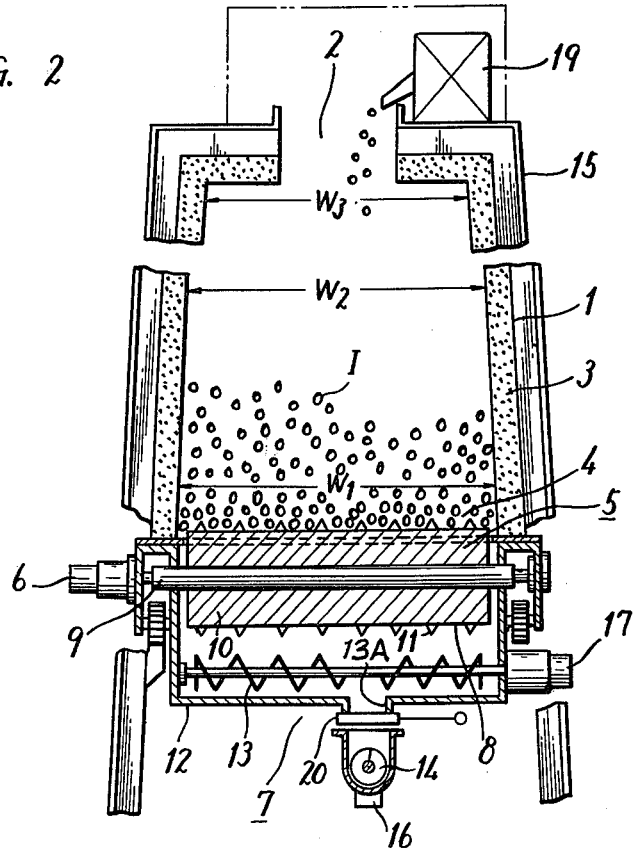
FIG. 2 is a partial side elevational view in cross section taken along the line II—II of the structure shown in FIG. 1.
Figure 3:
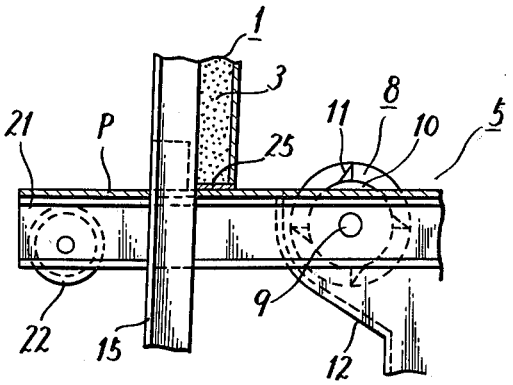
FIG. 3 is an enlarged fragmentary elevational view in cross section of a housing shown in FIG. 1 showing a lower marginal part of the sidewall.

Now referring to FIGS. 1 to 3, the reference numeral 1 designates a housing for storing pieces of ice which has an opening 2 at the top thereof adapted to receive broken ice therethrough. A thermal insulation wall 3 is provided at least on the internal sidewall surface of the inside wall surfaces enclosing and defining the inside thereof, namely the top wall surface, the sidewall surface and the bottom wall surface. The internal surface of the insulation wall 3 is smooth, thus forming an icebox.

The housing 1 has a truncated pyramid or cone shape, the inside cross-sectional area of which increases from the upper part thereof toward the lower part thereof. An opening 4 adapted to scratch out the pieces of ice is provided in the bottom wall surface.

A scratching-off device 5 for forming pieces of ice is provided at the lower part of the housing and is positioned so as to face toward the bottom opening 4. The scratching-off device, upon being energized and/or actuated by means of a driving motor 6, serves to drop the pieces of ice sequentially downwardly. Below the scratching-off device 5, there is positioned a delivery station 7 from which the pieces of ice can be removed from the device.

Various forms of the foregoing scratching-off device 5 may be used. In one example, as illustrated in FIGS. 2 and 3, a horizontal type of a scratching-off device is used in which a pair of rotary shafts 9, 9 as a principal member are juxtaposed. The rotary shafts 9, 9 comprise horizontally extending drums 8, 8 which are provided dispersedly with projecting points 11 on the periphery thereof. The drums 8, 8 are rotated about the axes of the shafts 9, 9, are spaced apart a predetermined distance from each other and extend in parallel relationship to each other. A driving motor 6 is drivingly connected to the shaft 9, 9.

When the driving motor is actuated, both the rotary drums 8, 8 are rotated mutually inwardly and in the opposite direction while the rotating bites strike against the collection of pieces of ice I heaped up immediately above the bottom opening 4 which faces toward the rotary drums 8, 8 and scratch off and drop the pieces of ice I downwardly.

The rotary drums 8, 8 are encased in a parallel extending casing 12 forming a funnel-like shape in cross-section, which casing is smoothly convergingly tapered in its sidewall surface toward its lower outlet end for discharging the pieces of ice therefrom.

The pieces of ice I scratched off are dropped into the casing 12 and the outlet end.

A delivery station 7 is positioned below the scratching-off device 5 and the outlet end of the casing 12. The delivery station has at least two stages of conveyors 13, 14 (in the case of the drawings, two stages), the axes of which are oriented horizontally and intersect each other at right angles. The upper stage of the longitudinally traversing conveyor 13 is encased in the casing 12 immediately below the rotary drums 8, 8 and above the outlet and the lower stage of transversely traversing conveyor 14 being attached to a frame 15 fixed to the housing 1. The axis of the conveyor 13 extends perpendicular to the axis of the conveyor 14.

The conveyors 13, 14 may be, for example, horizontally extending screw conveyors, which are operated as follows: When both the conveyors 13, 14 are driven by means of motors 17, 18, the longitudinally traversing conveyor 13 carries and collects the pieces of ice scratched off by the scratching-off device 5 to the discharge outlet 13A (see FIG. 2) located in the central area and then, the transversely traversing conveyor 14 transfers the pieces of ice thus dropped from the outlet into a downwardly opening mouth or outlet 16 at one end thereof for removal of the pieces of ice, whereby the pieces of ice I in discrete form can be taken out continually from the stationary mouth or outlet 16.

The apparatus for storage of pieces of ice can accumulate pieces of ice I fed from an ice-making machine 19 mounted on the upper wall of the housing 1 through the opening 2 into the inside of the housing 1 and keep them cool at low temperatures.

Pieces of ice, when in the state of accumulation, however, inevitably are refrozen to become secondary ice forms. Accordingly, the pieces of ice in discrete form become stuck together to form large aggregative masses of ice.

When the scratching-off device 5 and the conveyors 13, 14 are driven, the ice masses in the lowest layer are scratched off, the ice masses in the upper layers can move downwardly in sequence and drop continuously toward the outlet, even if forming a bridge between the sidewall surfaces, thus filling the spatial void formed in the lower part since the housing 1 is shaped so that the horizontal internal cross-sectional area is progressively increased from the top toward the bottom (in FIG. 2, $W_1 > W_2 > W_3$). As a result, it is possible to take out the pieces of ice continually without interruption and to solve the problem of interruption of delivery due to the formation of a spatial void which has hitherto gone unsolved.

Figure 6:
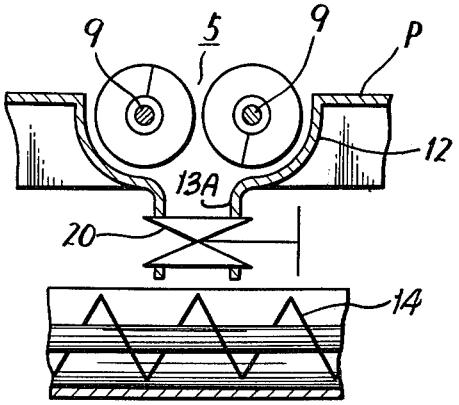

In FIG. 2 and FIG. 6, the reference numeral 20 designates a plate valve attached to the discharging outlet 13A in order to prevent the cold from leaking out.

The apparatus as shown in FIG. 1 to FIG. 3 has such a peculiar construction for carrying out the delivery of pieces of ice efficiently without any stagnation at the bottom part of the housing 1 and will, therefore, be described below in more detail.

In the housing 1, the bottom portion is shaped as a separate body from the sidewall members, and is constructed as a movable panel P capable of reciprocating horizontally.

The movable panel P is joined to the casing 12, so that the rotary drums 8, 8 encased in the casing will be shifted, relatively speaking, in relationship to the movable panel P.

The movement direction of the movable panel P is preferably determined to be orthogonal to the rotary shafts 9, 9 on the rotary drums 8, 8.

One example of a transferring device for facilitating a smooth reciprocation of the movable panel P is shown, in which a multi-wheel trolley 21 having a plurality of gear wheels 22, 22 thereon supports the movable panel P and is mounted on a rack rail 23 attached to the frame 15 through the gear wheels 22, 22.

When the gear wheels 22 are moved back and forth by the motor 24, the movable panel P and the scratching-off device 5 will be moved smoothly horizontally.

In order that the movable panel P and the lower margin of the sidewall of the housing 1 be kept hermetically sealed and in a slidable relation to keep the coldness sealed in, a thermally insulated rigid bottom plate 25 is affixed to the lower margin of the sidewall so as to be air-tight and slidably engaged with the movable panel P.

The apparatus for storage of pieces of ice thus constituted above can scratch off the pieces of ice accumulated in the lower part of the housing 1 by means of the moving scratching-off device 5 wholly and evenly all over the accumulated part when the movable panel P is reciprocated at a suitable speed geared to the scratching-off rate of ice. As a result, there is no such place that the pieces of ice fail to be scratched off and stagnate with the result that there is no dead angle place where some pieces of ice are left behind in the housing, waste by melting of lon-stayed ice is eliminated, the delivery rate of ice is continually stabilized, and the capacity of the housing is utilized more efficiently.

As a driving source of the movable panel P, a hydraulic cylinder 24' as well as the rotary motor may be, of course, used.

Figure 4:
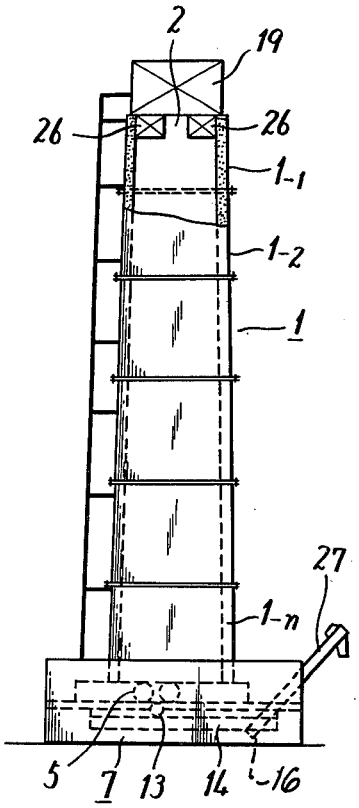
FIG. 4 is an elevational view of one example of a housing in an apparatus according to this invention with parts cut away.

FIG. 4 illustrates another example of the apparatus of this invention. The housing 1 is constructed of a plurality of housing blocks ($1_{-1}$) ($1_{-2}$) . . . ($1_{-n}$) stacked one upon another and united together, thus forming a vertical structure. The respective housing blocks ($1_{-1}$) ($1_{-2}$) . . . ($1_{-n}$) have sidewalls of such similar shapes to one another so as to be capable of defining one continuous planar surface and have each upper and lower openings.

The housing block ($1_{-1}$) at the most upper stage is provided with a cooler 26 around the periphery of the upper opening which is used as an inlet opening 2, whereas the housing block ($1_{-n}$) at the lowest stage is provided horizontally with the movable panel P at the lower opening and as described above.

In this way, a vertically elongated device having a large ice capacity can be built up. The number of vertically stacked housing blocks may be chosen appropriately depending upon the required ice capacity and on-site installation of the device can be performed with ease.

For instance, such device whose average horizontal sectional area and height are 4 $m^2$(2 m×2 m) and 10 m, respectively, is capable of containing about 40 $m^3$ of ice. With that device, notwithstanding such large capacity, a small area for the foundation is required for the installation, so that the land use is efficient.

In FIG. 4, 27 designates a delivery conveyor joined to the delivery mouth 16 of the carrying conveyor 14.

Figure 5:
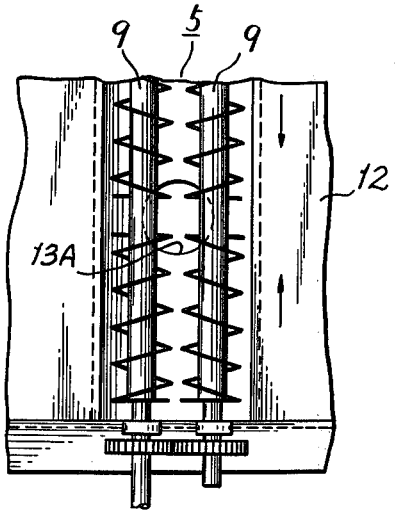
FIG. 5 is a partial top plan view and FIG. 6 is a partial elevational view in cross section, respectively, of one embodiment of a scratching device pertaining to an apparatus of this invention.

In FIG. 5 and FIG. 6, the scratching-off device illustrates an example of a screw conveyor construction in which spiral impeller blades of each conveyor are rotated about the rotary shafts 9, 9 disposed in parallel so that they are symmetrical to one another relative to the middle parts of the respective rotary shafts 9, 9. Each screw conveyor is, respectively, a right screw and a left screw. With this construction, when the rotary shafts 9, 9 are rotated, pieces of ice I are moved toward the discharge outlet 13A in the central region of the casing 12 while being gradually scratched off by the helical impeller blades, whereby the mass of ice can be not only scratched off, but also concurrently guided to the discharge outlet 13A. Therefore, it is possible to omit either of the two-stage conveyors 13, 14 in the apparatus of FIG. 1.

Each pair of figures, namely, FIGS. 7 and 8, FIGS. 9 and 10, and FIGS. 11 and 12, show the essential part of each example of the apparatus according to this invention.

Figure 7:
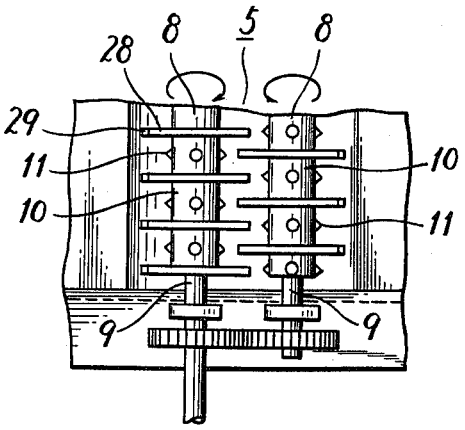
FIG. 7 is a partial top plan view and FIG. 8 is a partial elevational view in cross section, respectively, of one modification of the scratching-off device in the structure shown in FIG. 1.
Figure 8:
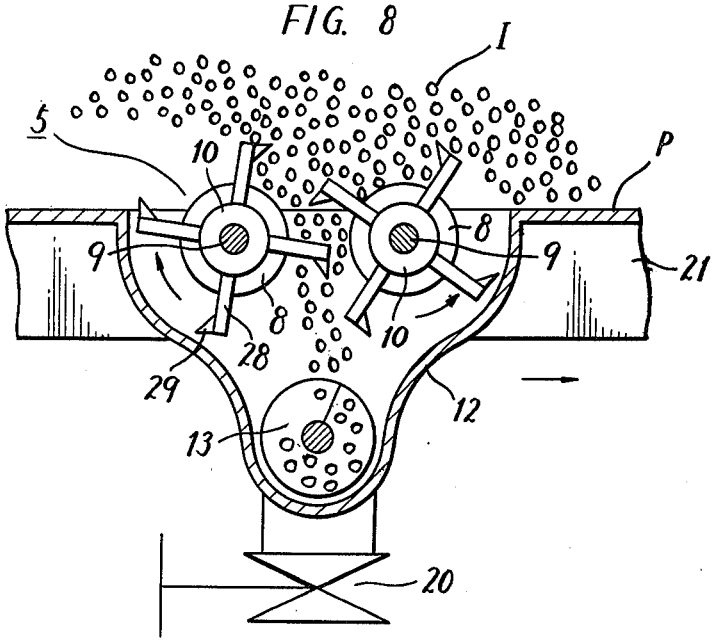

In FIG. 7 and FIG. 8, another scratching-off device 5 is shown, in which a plurality of arms 28 having a large acting radius as compared with the effective radius of the projections 11 on the circumference of the drum 10 are secured coaxially to the rotary drums 8, 8 in series and each has a bite 29 protruding at the tips thereof.

The bites 29 serve to break up aggregative masses of ice, and additionally, the projections 11 serve to further break up the broken ice masses into pieces, so that it is possible to remove large ice masses as small pieces of ice. Moreover, as the trolley 21 advances, a vacant space is developed at the rear side of the shifting scratching-off device 5, and filled gradually with large ice masses falling due to the gravity action until the movable panel P is piled up with the ice masses thereon when the device reaches the turn-back point. Thus, the bites 29 can act effectively to scratch off the ice masses with the result that the efficiency of the scratching-off device is significantly enhanced.

Figure 9:
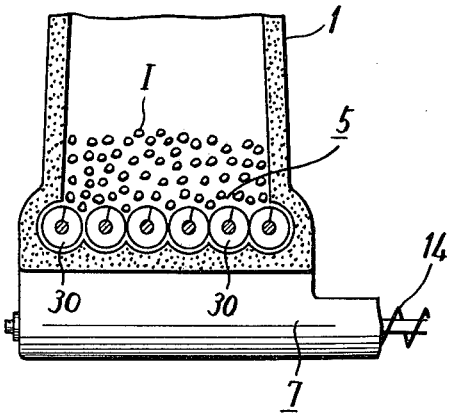
FIG. 9 is a partial elevational view in cross section and FIG. 10 is a partial side elevation view in cross section, respectively, of another embodiment embodying the invention.
Figure 10:
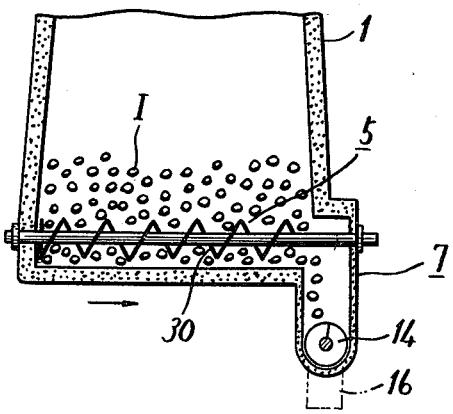

A further scratching-off device 5 is shown in FIG. 9 and FIG. 10. It has plural multi-screw conveyors 30, 30 stationarily arranged substantially all across the bottom of the housing 1, with which pieces of ice can be scratched off evenly and equally even when the device 5 is driven at the stationary position, so that the efficiency of the scratching-off device is enhanced.

The amount or rate of ice to be scratched off can be readily regulated by appropriately adjusting the number of the screw conveyors 30, 30 to be driven, for example by driving all of the conveyors or a part of the conveyors concurrently.

Figure 11:
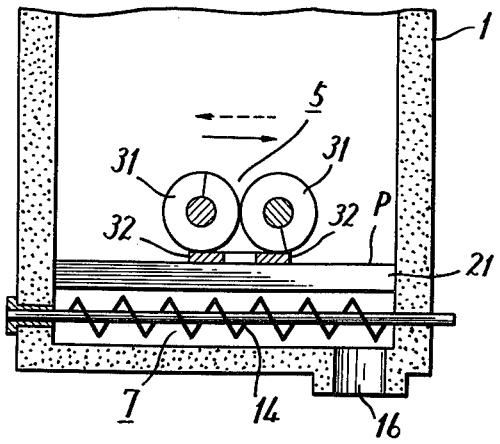
FIG. 11 is a partial elevation view in cross section and FIG. 12 is a partial side elevational view in cross section, respectively, of a further embodiment embodying the invention.
Figure 12:
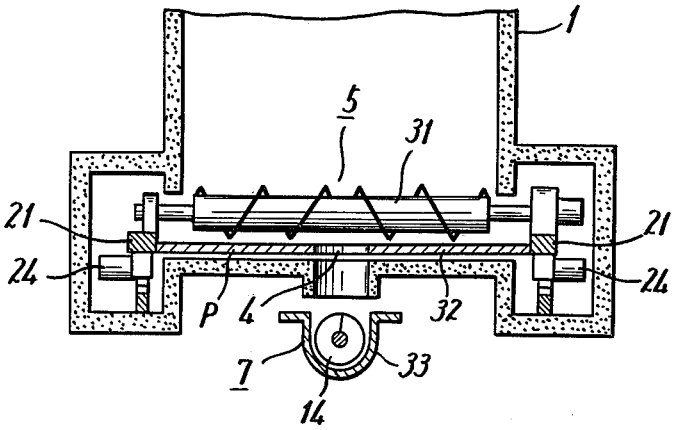

A still further scratching-off device 5 is shown in FIG. 11 and FIG. 12. This further device is spaced above the bottom of the housing 1 and is supported for reciprocal movement in the horizontal direction. The device is comprised of two screw conveyors 31 each having opposed screw segments thereon. Each screw conveyor effects a movement of pieces of ice toward the center thereof. Each of the conveyors are mounted on the trolley 21. This is in contrast to the preceding device in which the conveyor system is provided beneath the movable panel P and is movable therewith.

The trolley frame 32 has an opening 4 movable therewith. The opening travels above and along the length of the ice-delivery conveyor 33 disposed at a right angle to the advancing direction of the screw conveyors 31, 31. In this embodiment, it is preferred that the working length of the screw conveyor 31 be sufficient to act effectively over the entirety of the bottom of the housing 1. The gear wheels 22 and rack rail 23 are provided along the sidewalls of the housing 1.

With the foregoing construction of FIG. 11 and FIG. 12, only one stage of conveyor at the delivery station 7 is required, thereby simplifying the mechanism.

Figure 13:
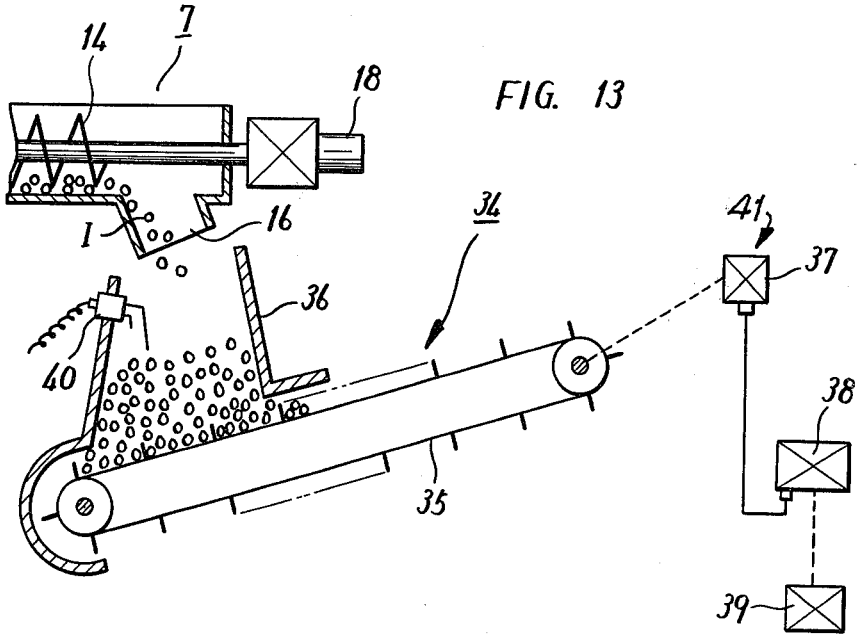
FIG. 13 is a schematic of a metering device pertaining to an apparatus of this invention.

In the apparatus for storage of ice illustrated in FIG. 13, there is provided an additional measuring function, namely, a measuring device 34 adjacent the outlet 16.

The measuring device 34 comprises an ice-transmission conveyor 35, a hopper 36 positioned between the outlet 16 and the elongated reach of the transmission conveyor 35 and an electric control device 41. The transmission conveyor 35 can be of any constant-volume type. A screw conveyor can also be applicable.

The hopper 36 has the shape of a truncated pyramid or cone shape similar to the foregoing housing 1. The horizontal internal cross-sectional area thereof is progressively increased from the top thereof to the bottom, and has a function of preventing pieces of ice from being re-frozen and assuming a bridge state therein and, accordingly, prevent them from being transmitted.

The electric control device 41 comprises a motor 37, a control board 38 incorporating a memory device, a quantitative indicator 39 for selecting a required amount and a level detector 40. These elements function as a measuring device and are provided within the hopper 36.

The operation of the measuring device described above is as follows.

When the indicator 39 is operated and adjusted to the desired definite amount of ice to be transmitted, the control panel 38 is acutated and the measuring operation is initiated. That is, when the level detector 40 detects a shortage of the amount within the hopper 36, the conveyor 14 is driven to deliver the ice to the hopper until the full amount is reached, after which it is stopped.

Thus, when the delivery rate is large the conveyor 14 is driven intermittently whereas when the delivery rate is small the transmission conveyor 35 is driven intermittently both in conformity with the operational indication of the control panel 38, with the result that the delivered amount equal to the predetermined amount is measured in terms of the cumulative operation period of time.

By providing the delivery station with the aforesaid measuring device 34, the storage and quantitative delivery of ice are thus feasible with a small loss of ice, so that a steady work operation can be performed during a packing in of the ice.

As thus far described, with the apparatus fabricated according to this invention, many advantages are attainable. Since the housing 1 serving as an icebox is of a contoured shape diverging downwardly in the horizontal sectional area, the pieces of ice can drop smoothly in sequence without stagnating even if refrozen. Further, the forming of the ice into a bridge state and causing the scratching-off device 5 to run idle is eliminated, thereby resulting in a continuous steady delivery of the ice.

The problem that some pieces of ice are left behind in the housing 1 without being removed and melting has been solved with the afore-described device.

The inside volume of the housing 1 can be utilized effectively and accordingly, the apparatus as a whole can be efficiently utilized, so that the apparatus can be made compact.

It is also advantageous that the ground surface area required for installation is small.

Quantification and stabilization of the delivery of ice are thus made possible.

The embodiments of the invention in which an exclusive property or privilege is claimed are defined as follows:

1. An apparatus for the storage and dispensing of ice, comprising:

a storage housing having upstanding sidewalls diverging in a direction from the top to the bottom thereof and adapted to store a quantity of ice therein;

insulation means insulating said upstanding sidewalls;

means defining a downwardly facing opening in a bottom part of said storage housing;

scratching-off means inside said storage housing and below said opening for breaking pieces of ice from said quantity of ice, said scratching-off means including at least two screw conveyors each rotatable about horizontal, coplanar and parallel axes, the screw blade of each screw conveyor effecting a horizontal conveyance of said pieces of ice along a path of movement in a direction parallel to said parallel axes;

outlet means located in said bottom part of said storage housing and oriented in alignment with said path of movement and being adapted to receive said pieces of ice therein; and conveyor means positioned in alignment with said outlet means and oriented to convey said pieces of ice at a right angle to said path of movement.

2. An apparatus for the storage of ice as claimed in claim 1, wherein said storage housing is an assembly of a plurality of housing blocks stacked one upon another and joined together, each of said housing blocks being opened at the top and bottom and having a sidewall of such similar shape to one another as capable of defining when assembled a continuous contoured surface.

3. An apparatus for storage of ice as claimed in claim 1, including a measuring device disposed adjacent to conveyor means and into which said pieces of ice are delivered and measured.

4. An apparatus for the storage of ice as claimed in claim 1, wherein said scratching-off means further comprises movable means with which said screw conveyors are reciprocatable in a horizontal direction in the housing.

5. An apparatus for the storage of ice as claimed in claim 1 or claim 4, wherein said screw conveyors are formed so that said screw blades of each screw conveyor are wound symmetrically relative to the lengthwise middle part of it.

6. An apparatus for the storage of ice as claimed in claim 4, wherein said movable means is a movable panel supported by means of gear wheels.

7. An apparatus for the storage and dispensing of ice, comprising:

a storage housing having upstanding sidewalls diverging in a direction from the top to the bottom thereof and adapted to store a quality of ice therein;

insulation means insulating said upstanding sidewalls;

means defining a downwardly facing opening in a bottom part of said storage housing;

scratching-off means inside said storage housing and below said opening for breaking pieces of ice from said quantity of ice, said scratching-off means including at least two rotating drums rotatable about horizontal, coplanar and parallel axes and having means thereon for biting into said quantity of ice, said drums extending across the entire width of said storage housing;

carriage means reciprocally mounted in said storage housing adjacent said bottom part and in a direction perpendicular to said width of said storage housing, said scratching-off means being rotatably mounted on said carriage means to effect a movement of said rotating drums relative to said quantity of ice all across the bottom surface thereof;

drive means for rotatably driving said drums;

casing means oriented below said drums on said carriage, said casing means having an outlet therein;

first elongated conveyor means mounted on said carriage means for conveying said pieces of ice toward said outlet, the longitudinal axis of said first conveyor means extending parallel to said axes of said drums; and second elongated conveyor means mounted on means fixed with respect to said storage housing, the longitudinal axis of said second conveyor means extending perpendicular to said axis of said first conveyor means, said second conveyor means including an inlet thereto aligned with said outlet in all positions of said carriage.

8. An apparatus for the storage of ice as claimed in claim 7, wherein said storage housing is an assembly of a plurality of housing blocks stacked one upon another and joined together, each of said housing blocks being opened at the top and bottom and having a sidewall of such similar shape to one another as capable of defining when assembled a continuous contoured surface.

9. An apparatus for storage of ice as claimed in claim 7, including a measuring device disposed adjacent to conveyor means and into which said pieces of ice are delivered and measured.

* * * * *